United States Patent [19]

Nakayama

[11] 4,231,972

[45] Nov. 4, 1980

[54] SUPPLY APPARATUS

[75] Inventor: Masafumi Nakayama, Fujisawa, Japan

[73] Assignee: Nissan Motor Company, Limited, Yokohama, Japan

[21] Appl. No.: 41,162

[22] Filed: May 21, 1979

[30] Foreign Application Priority Data

May 27, 1978 [JP] Japan ..... 53-63749

[51] Int. Cl.[3] ..... F02M 7/22

[52] U.S. Cl. ..... 261/44 D; 261/DIG. 39; 261/50 A

[58] Field of Search ..... 261/50 A, 44 D, DIG. 39

[56] References Cited

U.S. PATENT DOCUMENTS

| | | | |
|---|---|---|---|
| 1,212,887 | 1/1917 | Bergen | 261/50 A |
| 1,361,529 | 12/1920 | Marr | 261/50 A |
| 1,706,557 | 3/1929 | Baumgardner et al. | 261/50 A |
| 2,261,490 | 11/1941 | Weber | 261/50 A |
| 2,574,670 | 11/1951 | Sweeney | 261/50 A |
| 2,589,536 | 3/1952 | Carbonaro | 261/DIG. 39 |
| 3,054,603 | 9/1962 | Rodgers | 261/50 A |
| 3,664,648 | 5/1972 | Seeley, Jr. | 261/78R |
| 3,939,230 | 2/1976 | Simon | 261/DIG. 39 |
| 4,053,544 | 10/1977 | Moore | 261/DIG. 39 |
| 4,118,444 | 10/1978 | Abbey | 261/50 A |

FOREIGN PATENT DOCUMENTS

| | | | |
|---|---|---|---|
| 582663 | 9/1958 | Italy | 261/50 A |
| 53-137334 | 11/1978 | Japan | 261/50 A |

*Primary Examiner*—Tim R. Miles

*Attorney, Agent, or Firm*—Schwartz, Jeffery, Schwaab, Mack, Blumenthal & Koch

[57] ABSTRACT

In a venturi type fuel supply apparatus wherein a resistance member biased by a spring against a negative suction pressure is provided in an air suction passage to engage a throat formed therein and a needle valve is moved by the resistance member, a unitary structure for metering and ejecting fuel is disposed at the center of the air suction passage. The unitary structure comprises an outer and inner nozzles defining therebetween an air-fuel passage leading to fuel ejection ports. The lower end of the needle valve extends through the inner nozzle which communicates with a source of fuel.

10 Claims, 3 Drawing Figures

SUPPLY APPARATUS

BACKGROUND OF THE INVENTION

This invention relates to a fuel supply apparatus of an internal combustion engine, more particularly to a fuel supply apparatus of the type including a venturi carburetor provided with a single air suction passage wherein admixing of atomized fuel and air is effected uniformly.

A venturi carburetor is used widely as a means for producing a mixture of fuel and air. There are two types of venturi carburetors, one of which is provided with a single air suction passage. Another is a two stage dual carburetor which is provided with small and large venturis which function under a partial load condition and a high load condition, respectively.

In a former carburetor provided with the single air suction passage, if the diameter of the venturi is small, the loss due to the suction resistance will increase thereby decreasing the maximum output of the engine, although the engine can supply power that can satisfy full load and partial load at low engine speed. On the other hand, when the diameter of the venturi is increased, although the maximum output increases, not only the torque at low engine speed and full load decreases but also the fuel economy at partial load decreases.

To solve these problems, the latter two stages dual carburetor has been employed including the two suction passages wherein a small diameter venturi is used under partial load conditions, whereas a large diameter venturi is used under high load conditions. Even with such a carburetor, there is a problem in the initial fuel supply characteristic of the fuel flow at a main circuit under low load conditions. More specifically, when the air flow-amount is extremely small, the fuel atomization at the small venturi in the first stage is poor so that it is necessary to provide a slow circuit. However, where such slow circuit is provided, a problem is raised in the operative connection between the slow and main circuits. Furthermore, it is difficult to smoothly transfer from the first stage to the second stage when the second stage begins to operate.

To solve these difficulties a variable stage carburetor has been proposed wherein the air velocity is increased for the purpose of enhancing atomization of the fuel even at low load engine operating conditions. But such a carburetor is disadvantageous in that its construction is complicated, requiring high accuracy and increased expense to manufacture.

SUMMARY OF THE INVENTION

The present invention contemplates to overcome the drawbacks encountered in various conventional fuel supply apparatuses for internal combustion engines, by positioning a fuel metering and ejecting device in an air suction passage of a carburetor so that the metered fuel is ejected into the air suction passage downstream of throttle valves.

It is an object of the present invention to provide an improved fuel supply apparatus for an internal combustion engine, which can supply the engine with suitable amounts of fuel in accordance with engine operating conditions throughout all engine operating modes.

It is another object of the present invention to provide an improved fuel supply apparatus for an internal combustion engine, by which the atomization of fuel is improved and the homogeneous air-fuel mixture is effectively prepared, simplifying the construction and lowering the production cost of the fuel supply apparatus.

It is a further object of the present invention to provide an improved fuel supply apparatus for an internal combustion engine, which can always supply an air-fuel mixture having a suitable ratio into the engine, improving the fuel atomization at low load engine operating conditions and preventing the increase in flow resistance of suction air at a high engine speed operating condition.

Other objects, features and advantages of the fuel supply apparatus according to the present invention will become more apparent from the following description taken in conjunction with the accompanying drawings.

DESCRIPTION OF THE PREFERRED EMBODIMENT

Figure 1:
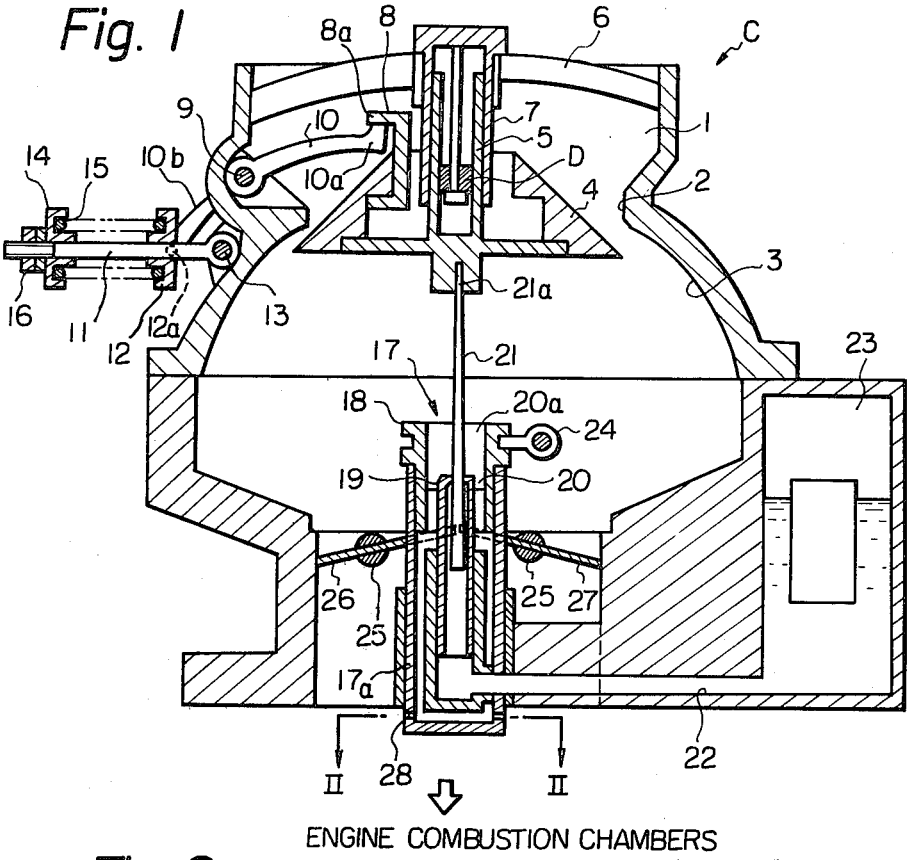
FIG. 1 is a longitudinal sectional view showing a preferred embodiment of a fuel supply apparatus according to the present invention.

Referring now to FIG. 1, a preferred embodiment of a fuel supply apparatus is shown including a carburetor C which has an air suction passage 1 in the form of a venturi tube. The air suction passage 1 is communicable with a combustion chamber or combustion chambers of an internal combustion engine though not shown. The venturi tube is provided with a throat 2 having a minimum cross-sectional area and a diverging member 3 formed on the downstream side of the throat and gradually increased in cross-sectional area as compared with the throat 2.

A bell-shaped restriction member 4 is disposed under the throat 2 to oppose the air suction passage 1. The resistance member 4 is provided with a rod 5 extending through the central portion thereof, the rod 5 being slidably received in a bearing 7 secured by radial supporting members 6 disposed at the upper end of the carburetor C. The rod 5 is formed as a cylinder containing a damper D for smoothly moving the resistance member 4.

A bracket 8 is provided for a portion of the resistance member 4, and the one end 10*a* of a lever 10, rotatably mounted on the wall surface of the carburetor C through a pin 9, engages the lower surface of a flange 8*a* on the upper end of the bracket 8. One end of a lever 10*b* provided on the outside of the carburetor is integral with the lever 10 and is mounted on the wall surface of the carburetor C, and the free end of the lever 10*b* is rotatably connected through a pin 12*a* to a sleeve 12 slidably mounted on a spring shaft 11. One end of the spring shaft 11 is rotatably connected to the side wall of the carburetor through a pin 13 whereas the other end of the spring shaft slidably carries a retainer 14. A spring 15 is interposed between the retainer 14 and the sleeve 12. The retainer 14 is positioned by a nut 16 so as to apply a predetermined rotating force to the lever 10 by the force of spring 15 thus supporting the resistance member 4 with a predetermined force. The arrangement described hereinbefore has already been disclosed in Japanese Patent Provisional Publication No. 53-137334, Publication date: Nov. 30, 1978l; (Japanese Patent Application No. 52-52845; Assignee: Nissan Motor Company, Ltd., Japan).

A fuel metering and ejecting device 17 is located beneath or downstream of the resistance member 4 and at the center of the air suction passage. The device 17 comprises a nozzle 18 having a large diameter and adapted to receive an inner nozzle 19 coaxially disposed in the nozzle 18. The nozzle 19 and the nozzle 18 are securely connected to each other to move as one body. The nozzle 18 is movably connected to a cylindrical member 17*a* forming part of the device 17. The cylindrical member 17*a* is secured at the center of the air suction passage 1 and is spaced apart from the wall surface defining the air suction passage 1. It is to be noted that the axis (not shown) of the cylindrical member 17*a* lies on the axis (not shown) of the air suction passage 1. A passage 20 for the emulsified mixture of fuel and air is formed between both nozzles 18 and 19. Within the nozzle 19 is fitted the lower portion of a needle valve 21 whose diameter decreases gradually toward the upper end 21*a* which is secured to the lower end of the resistance member 4. The lower end of the nozzle 19 communicates with a float chamber 23 through a passage 22, the chamber 23 having an upper space communicating with the air suction passage upstream of the resistance member 4, though not shown. The nozzle 18 is engaged by a rotatable lever 24 so that when the lever 24 rotates the nozzle 18 is moved in the vertical direction to increase or decrease the area of the opening of the nozzle 19 which is used to control the flow quantity of the fuel at idling and at cold start of the engine. As shown in FIG. 3, about the fuel metering member 17 are disposed semicircular throttle valves 26 and 27 supported by shafts 25 which are rotated simultaneously by gears, though not shown. Additionally, as viewed in section in FIG. 2, a plurality of ejection ports or openings 28 communicating with the passage 20 are formed through the cylindrical wall of the bottom portion of the member 17*a*. The ejection ports 28 are positioned on the downstream side of the throttle valves 26 and 27. The ejection ports 28 are arranged radially and are circumferentially spaced from each other.

Figure 2:
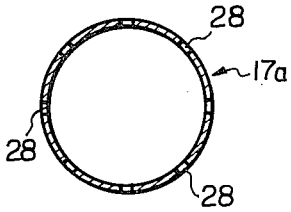
FIG. 2 is a cross-sectional view taken along a line II—II in FIG. 1.
Figure 3:
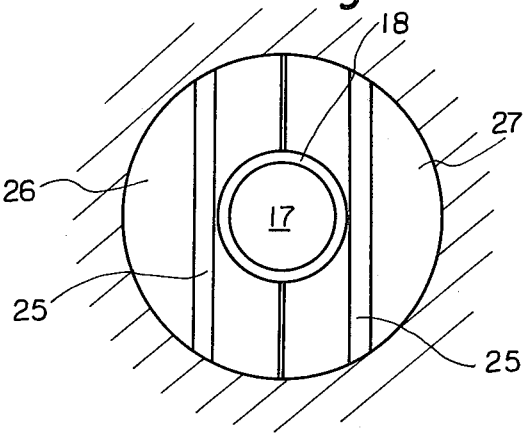
FIG. 3 is a plan view showing a throttle valve of the apparatus of FIG. 1.

The operation of the embodiment shown in FIGS. 1 to 3 will be now explained.

When no air is flowing through the air suction passage 1 while the engine is stopped, no air pressure acts upon the resistance member 4 so that it is urged upwardly by the lever 10 which is rotated by the force of spring 15. Consequently, the bevelled surface of the resistance member 4 engages the throat 2 to close the air suction passage 1.

When the engine starts to create an air suction of a degree depending upon the opening of the throttle valves 26 and 27, the pressure difference between the upper and lower surfaces of the resistance member increases. As the pressure difference becomes larger than the upward biasing force applied by the spring 15, the resistance member 4 moves downwardly to increase the areas of the passages between the resistance member 4 and the throat 2 and between the resistance member 4 and the diverging member 3. Thus, the resistance member 4 moves downwardly until the pressure drop of the sucked air stream caused by the increase of the cross-sectional area of the flow passage comes to balance with the upward force acting upon the resistance member 4.

It is to be noted that since the upward force acting to close the resistance member 4 is always maintained at a constant value the pressure difference between the upper and lower surfaces of the resistance member 4 is also maintained at a constant value. Thus, the quantity of the sucked air flow becomes proportional to the area of flow passage. In other words, the flow quantity increases in proportion to the amount of the stroke of the resistance member 4.

The displacement of the resistance member 4 corresponding to the quantity of the sucked air causes a displacement of the needle value 21 whereby the area of the opening of the nozzle 19 varies in accordance with the quantity of the sucked air flow. Moreover, since the pressure difference between the opening of the nozzle 19 and the float chamber 23 is maintained at a constant value which is equal to the pressure difference across the resistance member 4, the quantity of fuel flow is proportional to the area of the opening of the nozzle 19. As a result, a quantity of fuel proportional to the quantity of sucked air overflows through the opening of the nozzle 19 to thoroughly admix with the air flowing into the surrounding opening 20*a* and the resulting air-fuel mixture is ejected through the ejection ports 28 to produce an air-fuel mixture of a constant ratio. Since the ejection ports 28 are positioned on the downstream side of the throttle valves 26 and 27, they are influenced by the negative suction pressure. However, such effect of the negative suction pressure can be removed by increasing the diameter of the nozzle 18 and by decreasing the diameter of the fuel ejection ports. For this reason, the pressure in the nozzle 19 becomes equal to that in the air suction passage and the fuel is sucked by the negative pressure in the nozzle 19 and then ejected through radially arranged ejection ports 28 to the uniformly, admixed with air and atomized.

As shown and described, according to this invention, the fuel metering device is disposed at the center of the air suction passage and the fuel ejection ports are disposed in the radial direction on the downstream side of the throttle valves. Accordingly it is possible to uniformly atomize the fuel and admix it with air irrespective of the quantity of air flow.

What is claimed is:

1. A fuel supply apparatus of a venturi type for an internal combustion engine, comprising:

means defining a throat of an air suction passage which is communicable with the combustion chamber(s) of the engine;

a throttle valve located in the air suction passage downstream of said throat;

a resistance member which is movable in response to the suction vacuum of the engine to cooperate with said throat;

a needle valve secured to said resistance member to be movable with the movement of said resistance member;

an inner cylindrical member which is adapted to be filled with fuel and which is securely disposed at the center of the air suction passage, said inner cylindrical member comprising a nozzle opening for discharging fuel, said nozzle opening facing said resistance member and said needle valve being movably disposed in said nozzle opening so as to meter the fuel discharged from said nozzle opening in accordance with the movement of said needle valve; and an outer cylindrical member securely disposed around and being coaxial with said inner cylindrical member, said outer cylindrical member being closed at its end farthest from said resistance member and comprising in its cylindrical wall a plurality of ports which are located downstream of the throttle valve, said outer cylindrical member being spaced apart from said inner cylindrical member to form a passage through which a mixture of air and fuel from said nozzle opening passes in order to be ejected through said plurality of ports into said air suction passage.

2. A fuel supply apparatus as claimed in claim 1, wherein said outer cylindrical member includes a cylindrical portion at which said plurality of ports are formed, and an annular bottom flat portion closing the bottom of said outer cylindrical member.

3. A fuel supply apparatus as claimed in claim 1, wherein the axes of said inner and outer cylindrical members are parallel with the axis of said air suction passage.

4. A fuel supply apparatus as claimed in claim 1, wherein said plurality of ports are arranged radially and are circumferentially spaced from each other.

5. A fuel supply apparatus as claimed in claim 4, further comprising a float chamber adapted to be filled with fuel, and wherein the interior of said inner cylindrical member is in communication with said float chamber.

6. A fuel supply apparatus as claimed in claim 1 in which said needle valve increases in diameter as it nears its one end disposed in said inner cylindrical member.

7. A fuel supply apparatus as claimed in claim 6, in which said resistance member is in the shape of a frustum of a cone the frusto-conical surface of which is contactable with said throat.

8. A fuel supply apparatus as claimed in claim 7, further comprising a cylindrical nozzle member which is movably connected to said outer cylindrical member, said cylindrical nozzle member being formed with a nozzle opening through which the suction air is introduced into said passage, said cylindrical nozzle member being securely connected to said inner cylindrical member, and means for simultaneously moving said cylindrical nozzle member and said inner cylindrical member in accordance with an engine operating condition.

9. A fuel supply apparatus as claimed in claim 7, further comprising spring means for urging said resistance member into contact with said throat, said spring means including a first lever mechanically connected to said resistance member, which lever is rotatably supported on the wall defining said air suction passage, a rod rotatably attached to the outer surface of the wall defining said air suction passage, a spring retainer secured to said rod, a sleeve member slidably disposed around said rod, a second lever integral with said first lever and rotatably connected to said sleeve member, and a spring member disposed between said spring retainer and said sleeve member.

10. A fuel supply apparatus of a venturi type for an internal combustion engine, comprising:

means defining a throat of an air suction passage which is communicable with the combustion chamber(s) of the engine;

a pair of throttle valves located in the air suction passage downstream of said throat;

a resistance member which is movable in response to the suction vacuum of the engine to cooperate with said throat, said resistance member being in the shape of a frustum of a cone, the frustro-conical surface of which is contactable with the surface of said throat;

a needle valve secured to said resistance member to be movable with the movement of said resistance member, said needle valve member increasing in diameter as it nears its free end;

a float chamber adapted to be filled with fuel;

an inner cylindrical member which is in communication with said float chamber and is securely disposed at the center of the air suction passage, said inner cylindrical member comprising a nozzle opening for discharging fuel, said nozzle opening facing said resistance member and the end of said needle valve being movably disposed in said nozzle opening so as to meter the fuel discharged from said nozzle opening in accordance with the movement of said needle valve, the axis of said inner cylindrical member being parallel with the axis of said air suction passage;

an outer cylindrical member securely disposed around and being coaxial with said inner cylindrical member, said outer cylindrical member including a cylindrical portion and an annular flat bottom portion closing the end of said cylindrical member farthest from said resistance member, said cylindrical portion comprising a plurality of ports which are located downstream of the pair of throttle valves, said outer cylindrical member being spaced apart from said inner cylindrical member to form a passage through which a mixture of air and fuel form said nozzle opening passes in order to be ejected through said plurality of ports into said air suction passage; and spring means for urging said resistance member to contact with said throat, including a first lever mechanically connected to said resistance member, which lever is rotatably supported on the wall defining said air suction passage, a rod rotatably attached to the outer surface of the wall defining said air suction passage, a spring retainer secured to said rod, a sleeve member slidably disposed around said rod, a second lever integral with said first lever and rotatably connected to said sleeve member, and a spring member disposed between said spring retainer and said sleeve member.

* * * * *